US009679421B2

(12) United States Patent
Jaipaul et al.

(10) Patent No.: US 9,679,421 B2
(45) Date of Patent: Jun. 13, 2017

(54) VEHICLE LIFT CONFIGURED FOR INTEGRATION WITH VEHICLE DIAGNOSTIC COMPUTING DEVICES

(71) Applicant: Gray Manufacturing Company, Inc., St. Joseph, MO (US)

(72) Inventors: Larry M. Jaipaul, Clarence, NY (US); Todd Michalski, St. Joseph, MO (US)

(73) Assignee: Gray Manufacturing Company, Inc., St. Joseph, MO (US)

( * ) Notice: Subject to any disclaimer, the term of this patent is extended or adjusted under 35 U.S.C. 154(b) by 0 days.

(21) Appl. No.: 15/076,179

(22) Filed: Mar. 21, 2016

(65) Prior Publication Data

US 2016/0275729 A1 Sep. 22, 2016

Related U.S. Application Data

(60) Provisional application No. 62/135,415, filed on Mar. 19, 2015.

(51) Int. Cl.

| | |
|---|---|
| ***G07C 5/08*** | (2006.01) |
| ***B66F 3/00*** | (2006.01) |
| ***G07C 5/02*** | (2006.01) |
| ***B66F 3/24*** | (2006.01) |
| ***B66F 3/46*** | (2006.01) |

(52) U.S. Cl.
CPC ..... *G07C 5/08* (2013.01); *B66F 3/00* (2013.01); *B66F 3/24* (2013.01); *B66F 3/46* (2013.01); *G07C 5/02* (2013.01)

(58) Field of Classification Search
CPC ..... G07C 5/08; G07C 5/02; B66F 3/00
See application file for complete search history.

(56) References Cited

U.S. PATENT DOCUMENTS

2009/0027662 A1* 1/2009 Rogers ..... G01B 11/2755 356/139.09
2015/0105972 A1* 4/2015 Madison ..... G07C 5/085 701/33.2

* cited by examiner

*Primary Examiner* — Michael D Lang
(74) *Attorney, Agent, or Firm* — Hovey Williams LLP

(57) ABSTRACT

A vehicle lift comprising a main housing and a carriage assembly configured to engage a wheel of a vehicle, with the carriage assembly being vertically shiftable relative to the main housing. The vehicle lift additionally includes a lift control module for controlling actuation of said carriage assembly. The vehicle lift further includes a docking area configured to receive a diagnostic device, with the docking area including a power port configured to provide power to the diagnostic device.

20 Claims, 4 Drawing Sheets

VEHICLE LIFT CONFIGURED FOR INTEGRATION WITH VEHICLE DIAGNOSTIC COMPUTING DEVICES

RELATED APPLICATION

This non-provisional patent application claims priority to U.S. Provisional Patent Application Ser. No. 62/135,415, filed on Mar. 19, 2015, and entitled "VEHICLE LIFT CONFIGURED FOR INTEGRATION WITH VEHICLE DIAGNOSTIC COMPUTING DEVICES," the entire disclosure of which is incorporated by reference into this non-provisional patent application.

FIELD

Embodiments of the present invention relate to a vehicle lift configured for integration with a vehicle diagnostic computing device. In more detail, the present invention relates to a vehicle lift that is configured to integrate with a vehicle diagnostic computing device, such that the vehicle lift is capable of accessing and obtaining diagnostic information and performing vehicle diagnostic functions.

BACKGROUND

The need to lift a vehicle from the ground for service work is well established. For instance, it is often necessary to lift a vehicle for tire rotation or replacement, steering alignment, oil changes, brake inspections, exhaust work, and other automotive maintenance. Traditionally, lifting a vehicle has been accomplished through the use of equipment that is built-in to the service facility, such as either lift units with the hydraulic actuator(s) installed below the surface of the floor or two and four post type lift systems installed on the floor surface.

In an effort to increase the versatility and mobility of lift devices and reduce the need to invest in permanently mounted lifting equipment, devices commonly known as a mobile column lifts (MCL's) have been developed. An apparatus for lifting a vehicle using multiple MCL's is described in U.S. Pat. No. 6,315,079 to Berends et al. Another apparatus for lifting a vehicle using multiple MCL's is described in U.S. Pat. No. 6,634,461, the entire disclosures of which are incorporated herein by reference.

The functionality of prior MCL systems, such as those indicated above, is generally restricted to a minimal number of operations. For example, most MCL systems are restricted to performing simple operations such as raising and lowering of vehicles. Such MCL systems are not capable of performing vehicle diagnostic functions. Nevertheless, various other separate automotive diagnostic systems are generally available to perform such vehicle diagnostic functions. For instance, such currently available diagnostic systems include hand-held computing devices with wired connections for connecting the hand-held computing devices to a vehicle to obtain diagnostic information from the vehicle. However, as noted, such diagnostic systems are independent systems, which operate separately from the MCL systems. As such, a user of previously-used MCL systems is generally required to use entirely separate system for performing raising and lowering operations and for performing vehicle diagnostic functions.

Accordingly, there remains a need for a vehicle lift that is configured to integrate with a vehicle diagnostic computing device, such that the vehicle lift system can perform standard lifting operations as well as access or obtain diagnostic information and performing vehicle diagnostic functions.

SUMMARY

An embodiment of the present invention may include a vehicle lift comprising a main housing and a carriage assembly configured to engage a wheel of a vehicle, with the carriage assembly being vertically shiftable relative to the main housing. The vehicle lift additionally includes a lift control module for controlling actuation of said carriage assembly. The vehicle lift further includes a docking area configured to receive a diagnostic device, with the docking area including a power port configured to provide power to the diagnostic device.

An additional embodiment of the present invention may include a vehicle diagnostic system for use with a vehicle lift. The system may comprising a lift control module for controlling operation of the vehicle lift, with the lift control module including a graphic display. The system may also include a vehicle diagnostic device for obtaining diagnostic information from a vehicle, with the vehicle diagnostic device including a graphic display. The vehicle diagnostic device may also include an on-board diagnostic (OBD) module for connecting with an OBD system of the vehicle. The lift control module may be configured to mirror with the vehicle diagnostic device, such that graphics displayed on the graphic display of the vehicle diagnostic device are configured to be displayed on the graphic display the lift control module.

Embodiments of the present invention also include a non-transitory computer readable storage medium with a computer program stored thereon providing for a vehicle lift to obtain vehicle diagnostic information from a diagnostic device. The computer program is configured to instruct a processor to perform the following steps described below. An initial step may including receiving information indicative of an instruction to vertically shift the vehicle lift. An additional step may include generating an instruction to vertically shift the vehicle lift in response to the received information. An additional step may include establishing a communications link with the diagnostic device. An additional step may include receiving vehicle diagnostic information from the diagnostic device. An additional step may include generating a graphical user interface (GUI) displayable on a graphic display of a lift control module associated with the vehicle lift. A further step may include presenting at least a portion of the diagnostic information via the GUI of the lift control module. The above-described steps may alternatively be performed by a method, which may be computer-implemented.

This summary is not intended to identify essential features of the present invention, and is not intended to be used to limit the scope of the claims. These and other aspects of the present invention are described below in greater detail.

DRAWINGS

Embodiments of the present invention are described in detail below with reference to the attached drawing figures, wherein.

Figure 1:
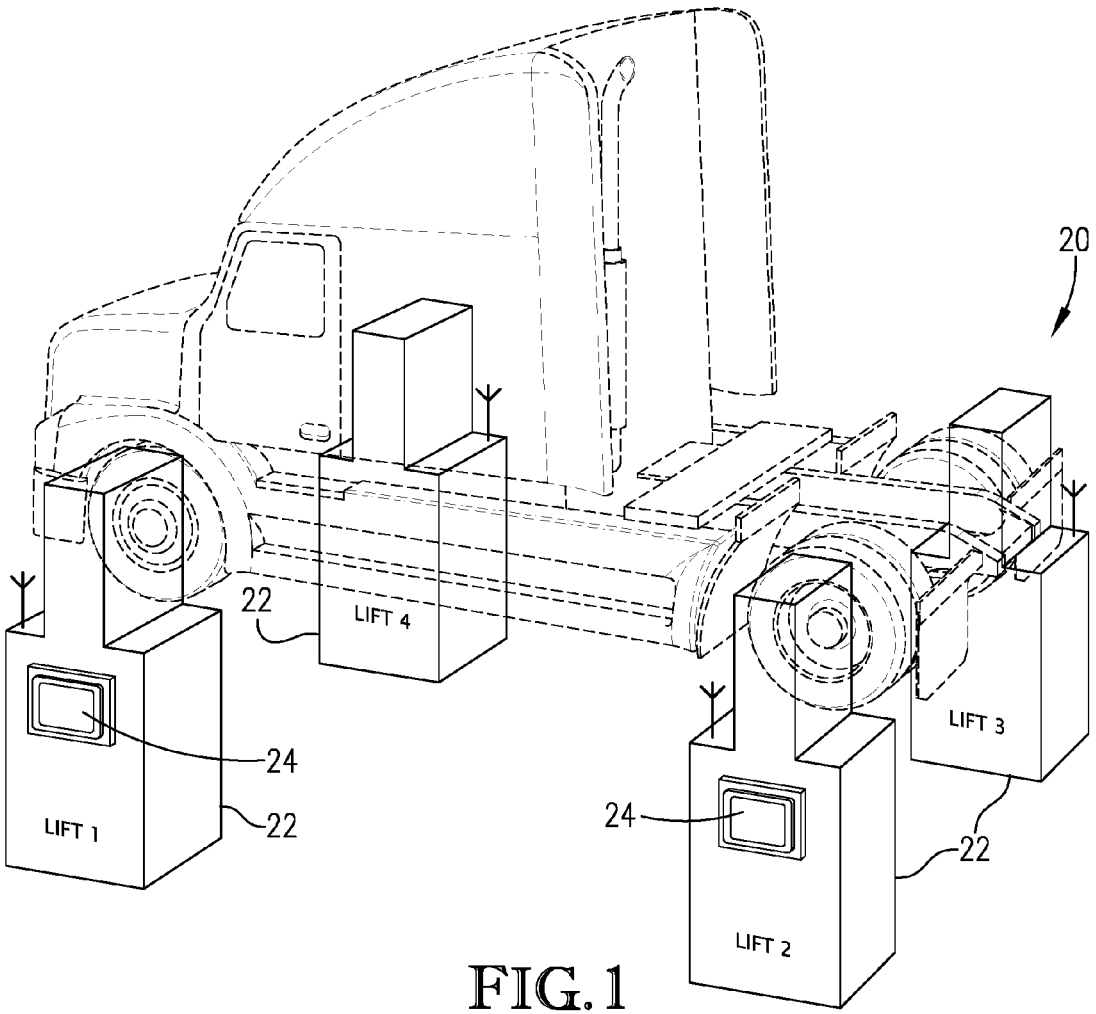
FIG. 1 is a simplified representation of a lift system according to embodiments of the present invention, with the lift system including four individual lifts being used to lift a vehicle.
Figure 2:
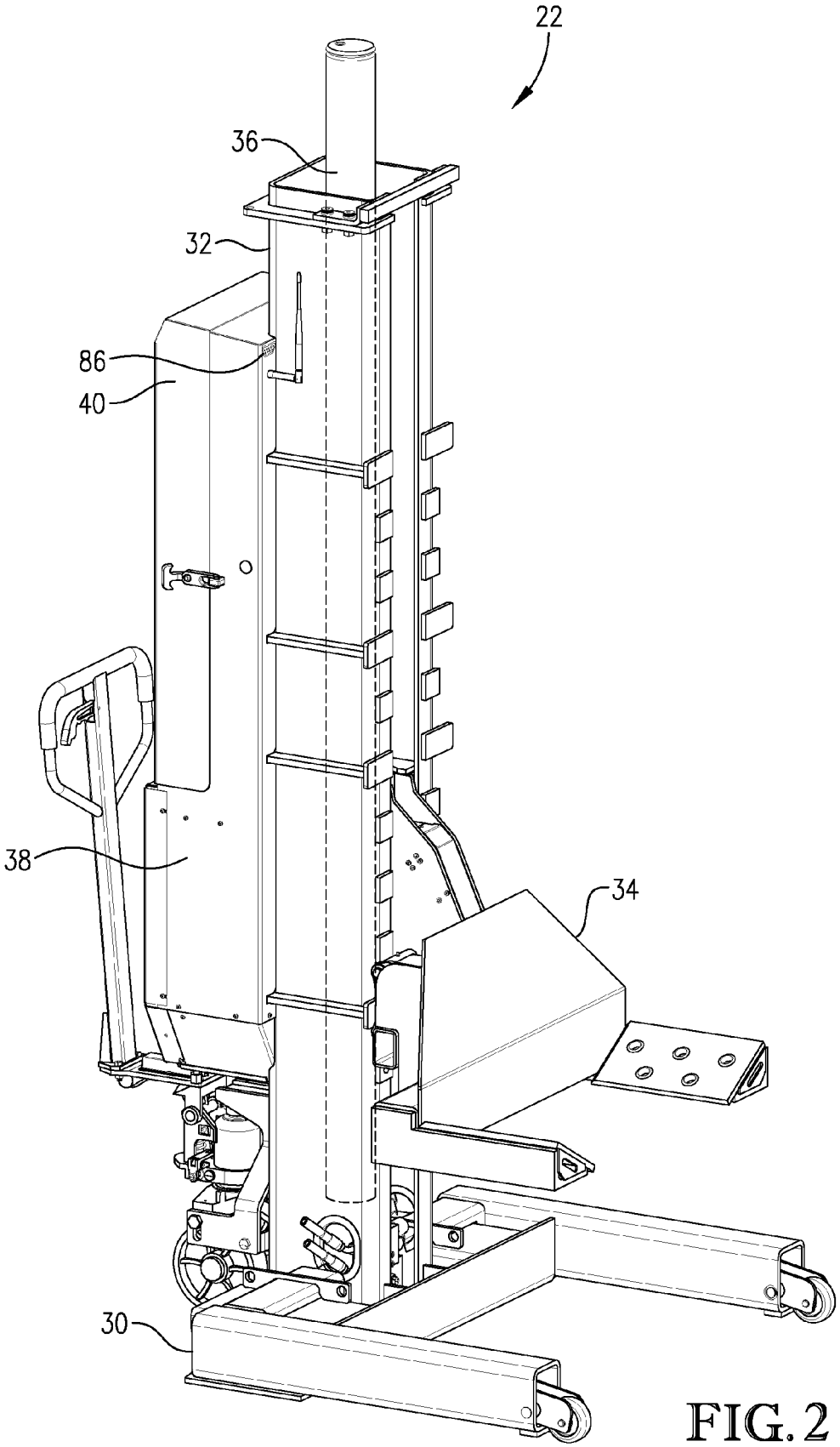
FIG. 2 is a is a perspective view showing the front and side of a lift configured in accordance with certain embodiments of the present invention.
Figure 3A:
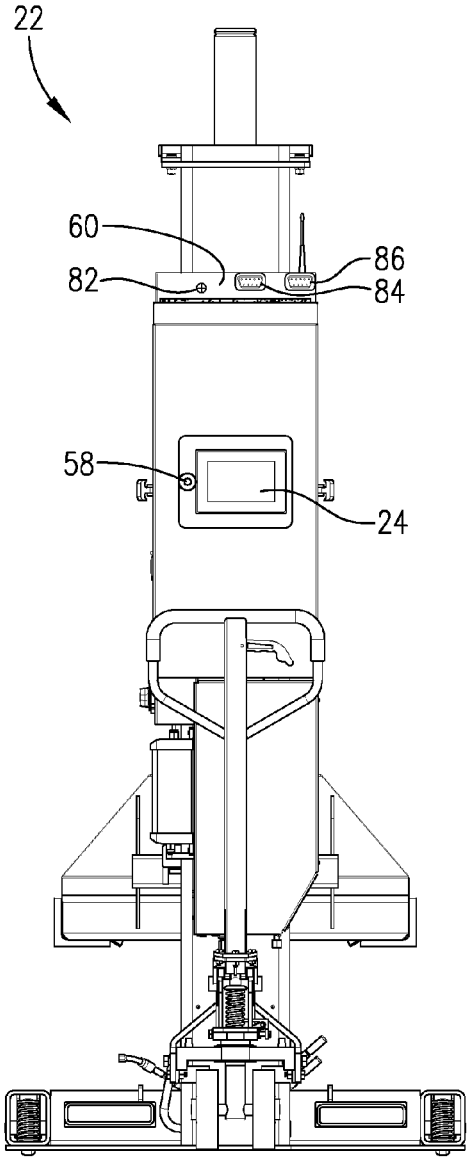
Figure 3B:
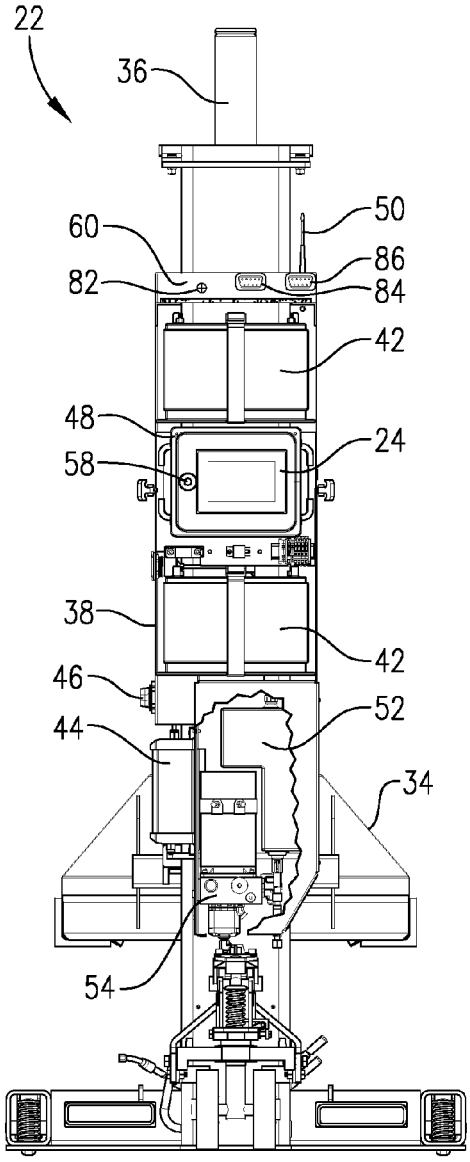
Figure 6:
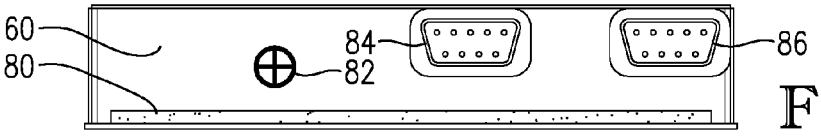
Figure 7:
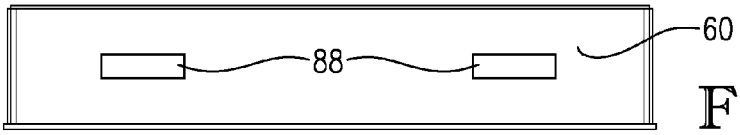
Figure 4:
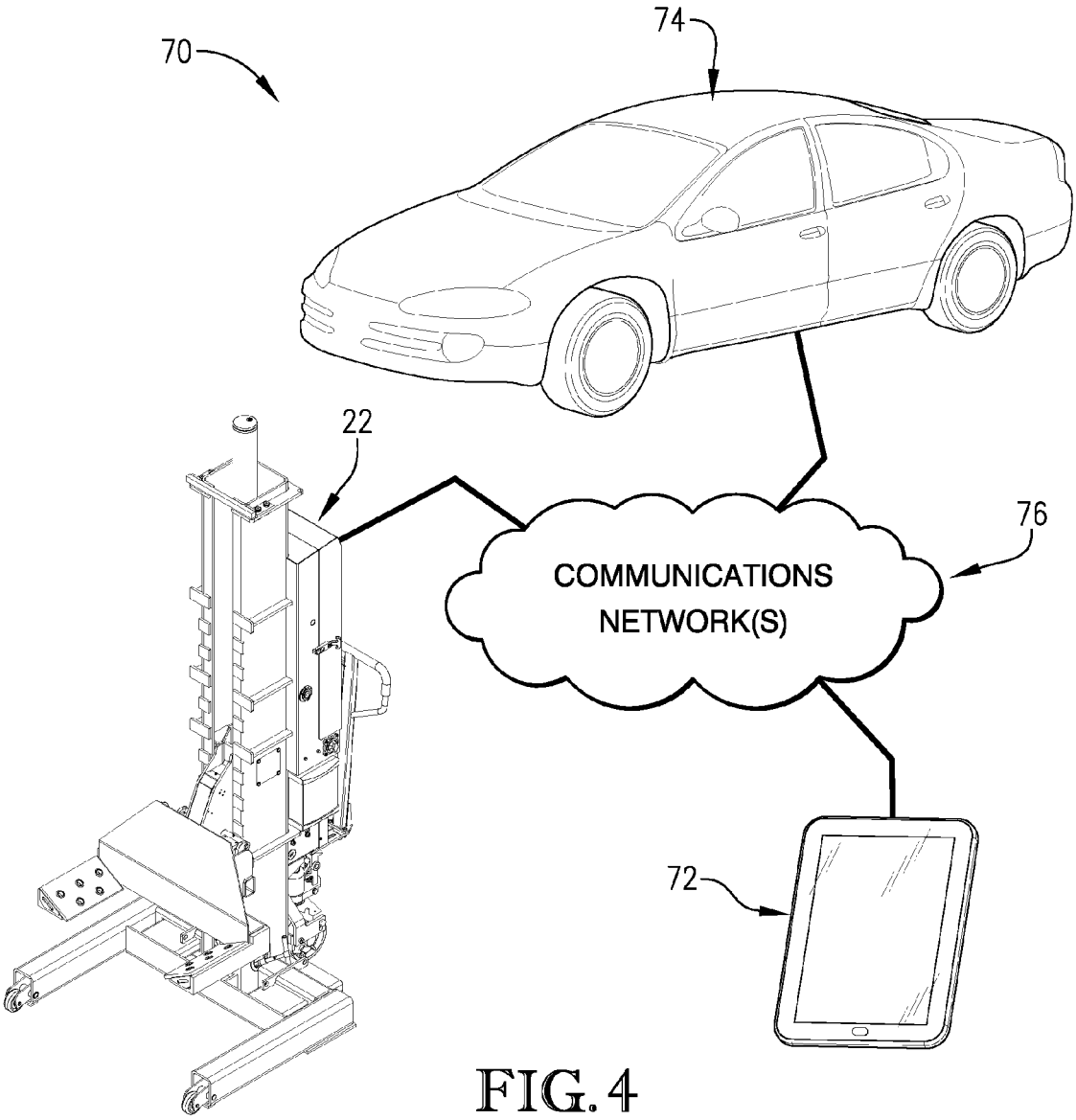
Figure 5:
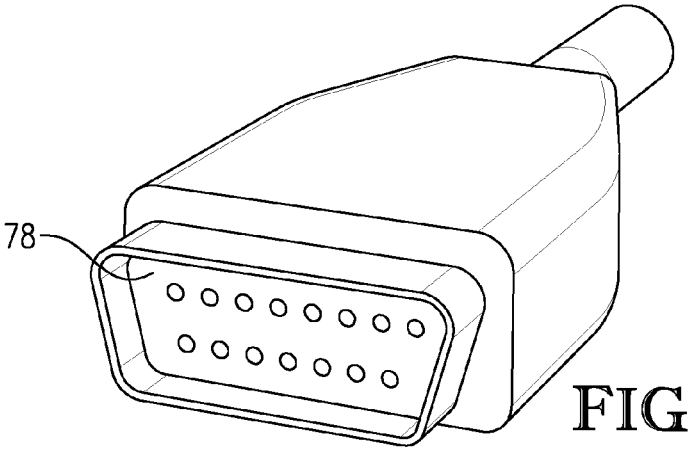

FIG. 3*a* is a back elevation view of the lift of FIG. 1;

FIG. 3*b* is as a back elevation view of the lift of FIG. 1, with certain portions of a main housing being removed or cut away to show individual components of the lift's electrical power system, lift control system, and hydraulic power system;

FIG. 4 is a schematic depiction of a vehicle diagnostic system according to embodiments of the present invention;

FIG. 5 is a perspective view of an on-board diagnostic module according to embodiments of the present invention;

FIG. 6 is a front elevation view of a docking area of the lift from FIGS. 2-3*b*, with the docking area including an electric power port, a first communications port, and a second communications port; and FIG. 7 is a front elevation view of an additional embodiment of a docking area for a lift, with the docking area including openings for passing wires or cables therethrough.

The figures are not intended to limit the present invention to the specific embodiments they depict. The drawings are not necessarily to scale.

DETAILED DESCRIPTION

The following detailed description of embodiments of the invention references the accompanying figures. The embodiments are intended to describe aspects of the invention in sufficient detail to enable those with ordinary skill in the art to practice the invention. Other embodiments may be utilized and changes may be made without departing from the scope of the claims. The following description is, therefore, not limiting. The scope of the present invention is defined only by the appended claims, along with the full scope of equivalents to which such claims are entitled.

In this description, references to "one embodiment", "an embodiment", or "embodiments" mean that the feature or features referred to are included in at least one embodiment of the invention. Separate references to "one embodiment", "an embodiment", or "embodiments" in this description do not necessarily refer to the same embodiment and are not mutually exclusive unless so stated. Specifically, a feature, structure, act, etc. described in one embodiment may also be included in other embodiments, but is not necessarily included. Thus, particular implementations of the present invention can include a variety of combinations and/or integrations of the embodiments described herein.

Lift System

Embodiments of the present invention are directed to a vehicle lift system configured to integrate with a vehicle diagnostic device for accessing or obtaining vehicle diagnostic information from a vehicle and/or for performing vehicle diagnostic functions for the vehicle. Referring to FIG. 1, reference numeral 20 generally designates a vehicle lift system having four individual lifts 22. The vehicle lift system 20 is similar, in certain respects, to the vehicle lift system described in U.S. Patent App. Publ. No. 2013/0240300, filed on Mar. 15, 2013, which is herein incorporated by reference in its entirety. Although FIG. 1 depicts a four lift 22 system, it should be understood that any combination of one or more lifts 22 may be used. For example, the lift system 20 may employ two, four, six, eight, or generally any number of individual lifts 22 as may be required. In certain embodiments, each of the lifts 22 may be substantially identical. It should also be understood that the lift system 20 is not necessarily limited for use with vehicles, but also may be used to raise or lower other objects relative to a floor or ground surface, such as aircraft, industrial machinery, shipping containers, construction subassemblies, and the like.

As shown in FIG. 1, each of the individual lifts 22 of the lift system 20 may be equipped with a lift control module 24 that is operable to perform independent functions as well as to control the functionality of any one or more of the lifts 22 of the system 20. In other embodiments, the lift system 20 may only include a single lift control module 24 that is operable to perform independent functions as well as to control each of the lifts 22.

In certain embodiments of the present invention, the lift control module 24 may include any type of computing device, such as any computing device, component, or equipment with one or more processors and/or associated memory elements. For instance, the lift control module 24 may comprise a work station, a desktop computer, a laptop computer, a palmtop computer, a tablet, and the like, or combinations thereof. The processor of the lift control module 24 may implement operating systems, and may generally be capable of executing computer programs, which are also commonly known as instructions, commands, software code, executables, applications, apps, and the like. The processors may include multiple processors, microprocessors, microcontrollers, field programmable gate arrays, and the like, or combinations thereof. The memory elements may be capable of storing or retaining computer programs, and may also store data, typically binary data, including text, databases, graphics, audio, video, combinations thereof, and the like. The memory elements may also be known as a "computer-readable storage medium" and may include random access memory (RAM), read only memory (ROM), flash drive memory, floppy disks, hard disk drives, memory cards, optical storage media such as compact discs (CDs or CDROMs), digital video disc (DVD), Blu-Ray™, and the like, or combinations thereof.

In some embodiments, the lift control module 24 may include a graphic display, such as a liquid crystal display, plasma, or touch screen (e.g., a capacitive digitizer, a resistive digitizer, or the like) that is operable to display visual graphics, images, text, etc. In certain embodiments, the lift control module 24 may be configured to present a graphical user interface (GUI) that is displayed via the graphic display. The GUI can enable users to interact with the lift control module 24 by touching or pointing at display areas on the graphic display to thereby provide information and commands to the lift control module 24.

Furthermore, the lift control module 24 may include other user control interface components, which enable users to share information and commands with the lift control module 24. In some embodiments, the user control interface may simply include the GUI. In other embodiments, the user control interface may comprise one or more functionable inputs such as buttons, keyboard, switches, scrolls wheels, voice recognition elements such as a microphone, pointing devices such as mice, touchpads, tracking balls, and styluses. The user control interface may also include a speaker for providing audible instructions and feedback. Further, the user control interface may comprise wired or wireless data transfer elements, such as a communication component, removable memory, data transceivers, and/or transmitters, to enable the user and/or other computing devices to remotely interface with the lift control module 24.

The lift control module 24 may communicate with the lifts 22 or with other computing devices through a communications network, which may comprise various networks, including wired or wireless networks. The communications network may including servers, routers, switches, wireless receivers and transmitters, and the like, as well as electrically conductive cables (e.g., serial cables) or optical cables. The communications network may also include local, metro, or wide area networks, as well as the Internet, or other cloud networks. Furthermore, the communications network may include cellular or mobile phone networks, as well as landline phone networks, public switched telephone networks, fiber optic networks, or the like.

Turning now to FIG. 2, a lift 22 configured in accordance with one or more embodiments of the present invention is illustrated. The lift 22 can include a base 30, a post 32, a carriage assembly 34, a lift actuator 36, and a main housing 38. The base 30 may be configured to support the lift on the floor or the ground. The post 32 may be rigidly coupled to the base 30 and can extend upwardly therefrom. The carriage assembly 34 may configured to engage the wheel of a vehicle and is vertically shiftable relative to the post 32. The lift actuator 36 may be received in the post 32 and is operable to vertically raise and lower the carriage assembly 34 relative to the post 32 and the base 30. The main housing 38 may be attached to the post 32 and is configured to enclose many of the components of that make up the lift control system and the power systems for the lift 22. The main housing 38 may include a removable access panel 40 for providing access to various components of the control and power systems of the lift 22. In certain embodiments, as shown in FIGS. 3*a* and 3*b*, the main housing 38 may also include a diagnostic device docking area 60 ("docking area") for removably receiving a vehicle diagnostic device, which will be discussed in more detail below. FIG. 3*b* provides a view of the back of the lift 22 with the access panel 40 being removed to show certain internal components located in an upper portion of the main housing 38. A lower portion of the main housing 38 is also cut away to show certain internal components located in a lower portion of the main housing 38.

In more detail, each of the lifts 22 may include an electrical power system, a lift control system, and a hydraulic power system. The electrical power system is configured to provide electrical power to the lift 22, and as illustrated in FIG. 3*b*, may include one or more rechargeable batteries 42, an electrical charger 44 for charging the batteries 42, and a main power switch 46. The lift may include an upper battery 42 and a lower battery 42, with each of the batteries comprising standard 12 Volt lead-acid batteries. The electrical charger 44 may comprise various electrical components, such as an AC-to-DC converter capable of converting an AC mains power to 12 Volt DC for charging the batteries 42. The main power switch 46 may selectively connect and disconnect the electrical components of the lift 22 from the batteries 42.

The lift control systems of the lifts 22 can control the functions and intra/inter communications of the lifts 22. The lift control system of each lift 22 may include the lift control module 24 (previously described), one or more internal processors and/or memory elements, and an antenna 50. The internal processors of the lifts 22 may implement operating systems, and may generally be capable of executing computer programs, which are also commonly known as instructions, commands, software code, executables, applications, apps, and the like. The processors may include multiple processors, microprocessors, microcontrollers, field programmable gate arrays, and the like, or combinations thereof. The memory elements may be capable of storing or retaining computer programs, and may also store data, typically binary data, including text, databases, graphics, audio, video, combinations thereof, and the like. The memory elements may also be known as a "computer-readable storage medium" and may include random access memory (RAM), read only memory (ROM), flash drive memory, floppy disks, hard disk drives, memory cards, optical storage media such as compact discs (CDs or CDROMs), digital video disc (DVD), Blu-ray™, and the like, or combinations thereof. In certain embodiments, the lift control system for each lift 22 may comprise two, three, four, five or six processors in each lift 22. In some embodiments, the internal processors of the lift control system may control the functionality of the lifts 22. However, in other embodiments, the lift control modules 24 may control generally all functionality of the lifts 22. The antenna 50 of each lift 22 may comprise a transceiver capable of sending and receiving communications from the other lifts 22, from lift control modules 24, and/or from other computing devices.

The hydraulic power system of the lift 22 can be used to actuate the lift actuator 36 and the carriage assembly 34 of the lift 22 for purposes of raising and lowering a vehicle. The hydraulic power system can include a hydraulic reservoir 52 and a hydraulic pump 54. The hydraulic pump 54 may be configured to pump hydraulic fluid from the hydraulic reservoir 52 into engagement with the lift actuator 36 to raise the carriage assembly 34. An opposite procedure can be used to lower the lift 22. FIG. 3*b* further shows that, in some embodiments, each lift 22 may include an emergency stop (E-stop) switch 58, which may be used to halt operation of the lift 22 (i.e., lowering or lifting) during an emergency.

Furthermore, as will be discussed in more detail below, the lifts 22 may include the diagnostic device docking area 60 (See FIGS. 3*a*-3*b*) for removably receiving a vehicle diagnostic device. As such, the lifts 22 can be capable of accessing and obtaining diagnostic information and performing vehicle diagnostic functions.

Vehicle Diagnostic System

In addition to the lift system 20 described above, embodiments of the present invention include a vehicle diagnostic system for integrating one or more of the lifts 22 of the lift system 20 with a vehicle diagnostic device ("diagnostic device"). As illustrated in FIG. 4, the vehicle diagnostic system is illustrated by reference numeral 70 and may broadly comprise a diagnostic device 72, which may be in data communication with one or more of the lifts 22 and a vehicle 74 via a communications network 76. The diagnostic device 72 may comprise any electronic device, component, or equipment with a processing element and associated memory elements and that is configured to interact with a vehicle, such as vehicle 74, for purposes of accessing and obtaining diagnostic information from the vehicle and/or for performing vehicle diagnostic functions. In some embodiments, as will be discussed in more detail below, the diagnostic device 72 may comprise a mobile electronic device, such as a tablet (See, e.g., FIG. 4). Nevertheless, the diagnostic device 72 may be any standard diagnostic device configured to obtain diagnostic information from vehicles, such as may be available from various third-party manufacturers and retailers. It should be understood that, in some embodiments, the diagnostic device 72 is an electronic device that is separate and distinct from the lift control module 24 of the lift 22.

The diagnostic device 72 may specifically comprise a wireless, handheld mobile electronics device such as a tablet, a laptop computer, a palmtop computer, a portable digital assistant (PDA), and the like, or combinations thereof. The processing element(s) of the diagnostic device 72 may implement operating systems, and may be capable of executing computer programs, which are also generally known as instructions, commands, software code, executables, applications, apps, and the like. The processing element(s) may include processors, microprocessors, microcontrollers, field programmable gate arrays, and the like, or combinations thereof. The memory elements may be capable of storing or retaining the computer program and may also store data, typically binary data, including text, databases, graphics, audio, video, combinations thereof, and the like. The memory elements may also be known as a "computer-readable storage medium" and may include random access memory (RAM), read only memory (ROM), flash drive memory, floppy disks, hard disk drives, optical storage media such as compact discs (CDs or CDROMs), digital video disc (DVD), Blu-ray™, and the like, or combinations thereof.

In some embodiments, the diagnostic device 72 may have a graphic display, such as a liquid crystal display, plasma, or touch screen (e.g., a capacitive digitizer, a resistive digitizer, or the like) that is operable to display visual graphics, images, text, etc. In certain embodiments, the diagnostic device 72 may be configured to present a graphical user interface (GUI) that is displayed via the graphic display. The diagnostic device 72 may also include other types of user control interfaces that enable users to share information and commands with the diagnostic device 72. For instance, the user control interface may comprise one or more functionable inputs such as buttons, keyboard, switches, scrolls wheels, voice recognition elements such as a microphone, pointing devices such as mice, touchpads, tracking balls, styluses. The user control interface may also include a speaker for providing audible instructions and feedback.

The diagnostic device 72 may communicate with the lifts 22, with the vehicle 74, or with other computing devices through a communications network 76, which may comprise the same communications network described above with respect to the lift system 20. For instance, the communications network 76 may comprise various types of wired or wireless (e.g., WiFi™ and Bluetooth™) networks. As such, the communications network 76 may including servers, routers, switches, wireless receivers and transmitters, and the like, as well as electrically conductive cables (e.g., serial cables) or optical cables. The communications network 76 may also include local, metro, or wide area networks, as well as the Internet, or other cloud networks. Furthermore, the communications network 76 may include cellular or mobile phone networks, as well as landline phone networks, public switched telephone networks, fiber optic networks, or the like.

The diagnostic device 72 may include wired or wireless data transfer elements necessary to communicate over the communications network 76. For instance, the diagnostic device 72 may include data transceivers, transmitters, and/or removable memory, to enable the user and/or other computing devices to communicate and remotely interface with the diagnostic device 72. For instance, the diagnostic device 72 may include communication components necessary for connecting to and communicating with the lift control module 24 and/or the lift 22, such as a serial port (e.g., USB, RS-232, or the like) for a wired connection or a transceiver (e.g., WiFi, Bluetooth, etc.) for a wireless connection. For the wired connection, the diagnostic device 72 may be associated with one or more serial cables (e.g., USB cable, RS-232 cable, or the like) for connecting with the diagnostic device's 72 serial port.

Additionally, as shown in FIG. 5, the diagnostic device 72 may be associated with an "on-board diagnostics" (OBD) module 78 capable of connecting to the vehicle's 74 OBD system. It should be understood that the term OBD in the present application can include reference to any standard OBD interface, such as ALDL, M-OBD, OBD-I, OBD-1.5, OBD-II, EOBD, EOBD2, JOBD, ADR, or the like. In some embodiments, the OBD module 78 may comprise a wirelessly configured OBD connector configured to connect with the vehicle's OBD system and wirelessly transmit (e.g., via WiFI™ or Bluetooth™) information to the diagnostic device 72. Alternatively, in some embodiments, the OBD module 78 may comprise an OBD cable with a first end including an OBD connector for connecting with the OBD system on the vehicle 74, and a second end of the OBD cable including a serial connector (e.g., USB cable or RS-232) for connecting with the diagnostic device 72.

In view of the above, the diagnostic device 78 can be configured for communication with both (1) the lift 22 and/or the lift control module 24, and (2) a vehicle 74. Similarly, the diagnostic device 72 may be able to communicate with other computing devices as well.

As mentioned above, one or more of the lifts 22 of the lift system 20 and/or the vehicle diagnostic system 70 may include docking area 60 which is configured to removably receive the diagnostic device 72. As used herein, the docking area 60 being configured to "removably receive" the diagnostic device means that the docking area 60 can both (1) support the diagnostic device 72 within or on the lift 22 during operation of the diagnostic device 72, and (2) permit the diagnostic device 72 to be removed from the docking area 60 in a manner that allows the diagnostic device 72 to remain operational upon removal. As such, the diagnostic device 72 is functional whether it is received within the docking area 60 of the lift 22 or whether it is outside of the docking area 60.

As shown in FIGS. 3*a*-3*b*, the docking area 60 may comprise a compartment-type area within the main housing 38. It should be understood that the docking area 60 may be positioned at various locations inside or outside of the main housing 38. Nevertheless, in the embodiments shown in the drawings, the docking area 60 may be positioned above the upper battery 42. The docking area 60 may comprise one or more compartment-type components within the main housing, such that the docking area 60 may be bounded by components of the main housing 38. For instance, as illustrated in FIG. 3*b*, the docking area 60 may include a base platform positioned immediately above the upper battery 42 and may be bounded by sidewalls and a backwall of the main housing 38. In some embodiments (not shown in the drawings), the docking area may be enclosed by the access panel 40, such that access to the docking area 60 may only be obtained by opening the access panel 40 on the back side of the lift 22.

In some embodiments, as shown in FIG. 6, the docking area 60 may include a padding material 80 positioned on the base platform. The padding material 80 may comprise a cushion for providing support to the diagnostic device 72 when the diagnostic device 72 is received within the docking area 60.

Additionally, the docking area 60 may include one or more electrical ports for facilitating communication and/or power transfer to and from the diagnostic device 72. It is understood that the diagnostic device 72 may be connected to such electrical ports via electrical cables, wires, and the like. For instance, as perhaps best shown in FIG. 6, the docking area 60 may include an electric power port 82 for providing operating power and/or charging power to the diagnostic device 72. The electric power port 82 may be electrically connected to the lift's 22 electrical power system (e.g., the batteries 42), such that the diagnostic device 72 can receive operating power or recharging power directly from the lift 22. The docking area 60 may also include one or more communications ports. For instance, with reference to FIG. 6, the docking area 60 may include a first communications port 84 (e.g., serial port), which may be electrically connected to the lift control module 24. As such, the diagnostic device 72 can be in data communication with the lift control module 24 via the first communications port 84.

In some alternative embodiments, the diagnostic device 72 may be connected directly to lift control system of the lift 22 via the first communications port 84 or via another communications port. In still further embodiments, the docking area 60 may not include the first communications port 84, such that the diagnostic device 72 will not be in data communication with the lift control module 24 and/or the lift 22.

In some embodiments, the docking area 60 may further include a second communications port 86 which connects an interior of the docking area 60 with an exterior of the lift 22 (See FIG. 2). A such, the second communications port 86 may facilitate data connection to the vehicle 74 via the OBD module 78. For instance, the second communications port 86 may be a serial port, such that the serial connector at the second end the OBD cable can connect to the diagnostic device via the second communications port 86, while the OBD connector at the first end of the OBD cable can be connected to the vehicle's 74 OBD system.

In some alternative embodiments, as shown in FIG. 7, the OBD cable and/or electrical power cable associated with the diagnostic device 72 may be passed from openings 88 formed in the docking area 60 of the lift 22 for connection with the vehicle and/or an external power outlet, respectively. As such, the electrical ports of the docking area 60 may not be required in all embodiments of the present invention.

Operation

In operation, a user can use the lift 22 to access or obtain diagnostic information and/or to perform vehicle diagnostic functions, each in addition to the standard operations normally performed with the lift 22 (i.e., raising/lowering operations). In certain instances, embodiments of the present invention will include a computer program that may run on the lift control module 24 (or alternatively on the lift 22 or the diagnostic device 72). The computer program of embodiments of the present invention may comprise a plurality of code segments executable by the lift control module 24 for performing various steps of methods of the present invention, certain of which are discussed in more detail below.

In more detail, a user can use the lift control module 24 of the lift 22 to perform vehicle diagnostics and/or to access or obtain resulting diagnostic information without needing to separately operate a diagnostic device. To begin, given the vehicle diagnostic system 70 described above, the user may connect the OBD module 78 to the OBD system of the vehicle 74. In general, an OBD port for the vehicle's OBD system can be found under a dashboard on a driver's side of the vehicle 74. As previously noted, the OBD module 78 in the form of the OBD cable can be directly connected (in a wired manner) with the diagnostic device 72 via the openings 88, as the diagnostic device 72 is received within the docking area 60 of the lift 22. Alternatively, the OBD module 78 in the form of the OBD cable can be indirectly connected (in a wired manner) with the diagnostic device 72 through the second communications port 86 included in the docking area 60. In still further alternatives, the diagnostic device 72 may be wirelessly connected to the vehicle 74 via the wireless version of the OBD module 78, which was previously described.

Regardless of the method of connection between the diagnostic device 72 and the OBD module 78, the diagnostic device 72 is, thereafter, configured to obtain diagnostic information from the vehicle 74. Such diagnostic information may include vehicle diagnostic trouble codes (DTCs). Such DTCs are indicative of failures or problems with various systems in the vehicle 74, such as problems with the vehicle's electronic control unit (ECU). Furthermore, the diagnostic information may include other real-time information associated with the vehicle's 74 systems, such as on-board diagnostic parameter IDs (PIDs). Such PIDs are indicative of real-time operational data of various systems of the vehicle 74.

Once the diagnostic device 72 obtains the diagnostic information from the vehicle 74, the diagnostic device 72 can transmit the diagnostic information to the lift control module 24 for viewing and for use by the user of the lift 22. Such transmission may be wired or wireless, as previously described. For example, the diagnostic information may be transferred in a wired manner from the diagnostic device 72 to the lift control module 24 via the first communications port 84. Regardless of the method of communication, the diagnostic information (e.g., vehicle DTCs and PIDs) can be transmitted to the lift control module 24 for viewing and further use by the user of the lift 22.

In further embodiments, the computer program of the present invention, which may be operating on the lift control module 24, may include a mirroring application that allows the information that is graphically displayed on the graphic display of the diagnostic device 72 to be simultaneously displayed on the graphic display of the lift control module 24. Specifically, graphics information or data that is provided to the graphics display of the diagnostic device 72 may be simultaneously provided to the lift control module 24 for display. Such a functionality is herein referred to as "mirroring" (alternatively, "mirror" or "mirrored"), and may be performed wired (e.g., serial cables via the first communications port 84) or wirelessly (e.g., via WiFI™ or Bluetooth™). As such, any information displayed on the diagnostic device 72 can be mirrored in real-time on the lift control module 24 for viewing by the user of the lift 22. In addition, the diagnostic information provided to the lift control module 24 can be further provided to another computing device for storage or for further analysis.

Additionally, embodiments of the present invention may provide for the computer program on the lift control module 24 to include a user interface sharing protocol, which allows the lift control module 24 to remotely control the diagnostic device 72. Specifically, the lift control module 24 can transmit user interface events (e.g., mouse clicks, keyboard actions, GUI actions) to the diagnostic device 72. In some embodiments, the user interface events will be GUI actions performed by the user via the touchscreen of the lift control module 24. When used in conjunction with the mirroring capabilities, the lift control module 24 can be used to perform any of the functions that are generally performed with the diagnostic device 72.

For instance, as described above, the graphics normally displayed on the graphic display of the diagnostic device 72 can be mirrored on the graphic display of the lift control module 24. As such, the graphics of the diagnostic device 72 will be presented as an interactive GUI on the lift control module 24. The user of the lift 22 can interact with the GUI (e.g., via touchscreen) of the lift control module 24, and such interactions can be transmitted to the diagnostic device 72, so as to provide commands to the diagnostic device 72. Any resulting graphics displayed on the diagnostic device 72 will be transmitted back to the lift control module 24 for viewing by the user. As such, the graphic display of the diagnostic device 72 is interactively mirrored to the graphic display of the lift control module 24 (in the form of a GUI), such that the user can interact with the GUI of the lift control module 24 just as if the user was interacting with the diagnostic device 72. It is understood that embodiments of the present invention provide for such interactions to be performed in real-time, such that the user will have the ability to control the diagnostic device 72 in real-time from the lift control module 24. In certain embodiments, the user interface sharing protocol may only be one-way, such that the lift control module 24 can display the graphics from the diagnostic device 72 or can control the diagnostic device 72. However, the diagnostic device 72 may not be configured to display the graphics from the lift control module 24 or control the lift control module 24 (or the lift 22).

In view of the above, embodiments of the present invention may include a method for a vehicle lift 22 to obtain vehicle diagnostic information from a diagnostic device 72. An initial step may including receiving information indicative of an instruction to vertically shift the vehicle lift 22. An additional step may include generating an instruction to vertically shift the vehicle lift 22 in response to the received information. An additional step may include establishing a communications link with the diagnostic device 72. An additional step may include receiving vehicle diagnostic information from the diagnostic device 72. An additional step may include generating a graphical user interface (GUI) displayable on a graphic display of a lift control module 24 associated with the vehicle lift 22. A further step may include presenting at least a portion of the diagnostic information via the GUI of the lift control module 24. The above-described steps may be performed by a computer-implemented.

Furthermore, however, some embodiments of the present invention will not facilitate the diagnostic device 72 being in data communication with the lift control module 24 or with the lift 22. As such, the diagnostic device 72 may not be able to provide or receive data to/from the lift control module 24 or to control the functionality of the lift 22 through the lift control module. Similarly, the lift control module 24 may not be able to provide may not be able to provide or receive data to/from the diagnostic device 72 or to control the functionality of the diagnostic device.

Given the above, embodiments of the present invention provide for diagnostic information obtained from the vehicle 74, via the diagnostic device 72, to be further used by the lift control device 24 or another computing device. As such, the lift control module 24 or other computing device can perform additional analysis on the diagnostic information, such as diagnose issues with the vehicle 74, generate reports, generate alerts, or the like. Such diagnostic information may be compiled with other lift data to create master reports and alerts. For instance, lift data may include any data or information relevant to the safety, maintenance, and/or proper operation of the lifts 22 of the lift system 20. Specific examples of such lift data may include, energy (i.e., battery 42) usage, energy (i.e., battery 42) levels, lift height, lift velocity, lifting load weights, lifting frequencies, locations, or the like. Embodiments of the present invention provide for such lift data and diagnostic information to be regularly gathered for further use. For example, embodiments may regularly collect lift data and vehicle diagnostic information and compile such data and information into a master report, which may be used by users and/or owners of the lift system 20.

In additional embodiments, users of the lift system 20 may be provided with alerts to notify the users when a vehicle 74 being diagnosed by the lifts 22 and/or the diagnostic device 72 have a maintenance issue that needs immediate attention. In some embodiments, the alerts may be displayed directly on the graphic display of the lift control module 24. In other embodiments, the alerts may be transmitted in the form of an email, a text message, or an audio alert from the lift 22 to a remote computing device and/or server devices (e.g., the cloud) for review and analysis by users. Embodiments of the present invention also provide for analysis of such diagnostic information and lift data. In some embodiments, where the diagnostic information and lift data is stored on remote computing devices (e.g., the cloud), such diagnostic information and lift data is capable of being remotely accessed so as to provide remote, real-time access to data.

Although the invention has been described with reference to the one or more embodiments illustrated in the figures, it is understood that equivalents may be employed and substitutions made herein without departing from the scope of the invention as recited in the claims.

Having thus described one or more embodiments of the invention, what is claimed as new and desired to be protected by Letters Patent includes the following:

1. A vehicle lift comprising:

a main housing;

a lift actuator;

a carriage assembly configured to engage a wheel of a vehicle, wherein said lift actuator is configured to vertically shift said carriage assembly relative to said main housing;

a lift control module for controlling said lift actuator to vertically shift said carriage assembly;

a diagnostic device for connecting with an on-board diagnostic (OBD) system of a vehicle; and a docking area located within said main housing of said vehicle lift, wherein said docking area is configured to receive said diagnostic device, wherein said docking area includes a power port configured to provide power to the diagnostic device.

2. The vehicle lift of claim 1, wherein said docking area is configured to removably receive the diagnostic device.

3. The vehicle lift of claim 1, wherein the docking area further comprises a communications port configured to provide data communications between the diagnostic device and the lift control module.

4. The vehicle lift of claim 3, wherein the communications port is a serial port.

5. The vehicle lift of claim 3, wherein the lift control module is configured to mirror with the diagnostic device, such that graphics configured for display on a graphic display of the vehicle diagnostic device are configured to be simultaneously displayed on a graphic display of the lift control module.

6. The vehicle lift of claim 5, wherein the lift control module is configured to remotely control the diagnostic device.

7. The vehicle lift of claim 1, wherein said docking area includes a padding material for supporting the vehicle diagnostic device.

8. The vehicle lift of claim 1, wherein said power port of said docking area is connected with an electrical power system of the vehicle lift.

9. The vehicle lift of claim 1, wherein the diagnostic device is a handheld, mobile computing device configured to be in data communication with the OBD system of the vehicle.

10. The vehicle lift of claim 9, wherein the docking area further comprises a communications port configured to provide data communications between the diagnostic device and the OBD system of the vehicle.

11. The vehicle lift of claim 1, wherein the diagnostic device is not in data communication with lift control module.

12. A vehicle diagnostic system for use with a vehicle lift, said vehicle diagnostic system comprising:

a lift control module for controlling operation of the vehicle lift, wherein the lift control module includes a graphic display; and a vehicle diagnostic device for obtaining diagnostic information from a vehicle, wherein the vehicle diagnostic device includes a graphic display, wherein the vehicle diagnostic device includes an on-board diagnostic (OBD) module for connecting with an OBD system of the vehicle, wherein the lift control module is configured to mirror with the vehicle diagnostic device, such that graphics configured for display on the graphic display of the vehicle diagnostic device are configured to be simultaneously displayed on the graphic display the lift control module.

13. The vehicle diagnostic system of claim 12, wherein the vehicle diagnostic device comprises a mobile computing device, and wherein the OBD module comprises an OBD cable.

14. The vehicle diagnostic system of claim 12, wherein the vehicle diagnostic device is configured to obtain diagnostic information from the vehicle, and wherein the diagnostic information comprises vehicle diagnostic trouble codes and/or parameter IDs.

15. The vehicle diagnostic system of claim 14, wherein the lift control module is configured to mirror with the vehicle diagnostic device, such that the diagnostic information can be simultaneously presented on the graphic display of the diagnostic device and on the graphic display of the lift control module.

16. The vehicle diagnostic system of claim 12, wherein the lift control module is configured to remotely control the vehicle diagnostic device.

17. The vehicle diagnostic system of claim 12, wherein the lift control module is configured to be mirrored to the vehicle diagnostic device via wired connection.

18. A non-transitory computer readable storage medium with a computer program stored thereon providing for a vehicle lift to obtain vehicle diagnostic information from a diagnostic device, wherein the computer program is configured to instruct a processor to perform the following steps:

receive information, via a lift control module associated with the vehicle lift, indicative of user command to vertically shift the vehicle lift;

generate an instruction to vertically shift the vehicle lift in response to the received information;

establish a communications link with the diagnostic device;

receive vehicle diagnostic information from the diagnostic device;

generate a graphical user interface (GUI) displayable on a graphic display of the lift control module; and present at least a portion of the diagnostic information via the GUI of the lift control module.

19. The method of claim 18, wherein the diagnostic information comprises vehicle diagnostic trouble codes and/or parameter IDs.

20. The method of claim 18, wherein the computer program is configured to further instruct the processor to remotely control the vehicle diagnostic device.

* * * * *